US007274292B2

(12) United States Patent
Velhal et al.

(10) Patent No.: US 7,274,292 B2
(45) Date of Patent: Sep. 25, 2007

(54) PROXIMITY MANAGEMENT SYSTEM AND METHOD USING RADIO-FREQUENCY IDENTIFICATION TAGS

(75) Inventors: Ravindra V. Velhal, Beaverton, OR (US); Jeetendra G. Deshmukh, Beaverton, OR (US); Nikhil M. Deshpande, Beaverton, OR (US); R. Harold Crawford, Beaverton, OR (US); John D. Fowler, Dallas, TX (US)

(73) Assignee: Intel Corporation, Santa Clara, CA (US)

( * ) Notice: Subject to any disclaimer, the term of this patent is extended or adjusted under 35 U.S.C. 154(b) by 321 days.

(21) Appl. No.: 10/877,562

(22) Filed: Jun. 25, 2004

(65) Prior Publication Data

US 2005/0285739 A1 Dec. 29, 2005

(51) Int. Cl.
*G08B 1/08* (2006.01)

(52) U.S. Cl. ..... 340/539.32; 340/505; 340/539.16; 340/539.21; 340/572.4; 340/10.2; 340/10.6

(58) Field of Classification Search ..... 340/539.32, 340/539.14–539.16, 539.21, 568.1, 572.1, 340/825.49, 505, 10.1, 10.2, 10.6, 568.6, 340/572.4

See application file for complete search history.

(56) References Cited

U.S. PATENT DOCUMENTS 5,285,194 A * 2/1994 Ferguson ..... 340/572.4
5,939,981 A * 8/1999 Renney ..... 340/539.32
5,955,951 A * 9/1999 Wischerop et al. ..... 340/572.8
5,986,570 A * 11/1999 Black et al. ..... 340/10.2
6,043,746 A * 3/2000 Sorrells ..... 340/572.7
6,084,517 A * 7/2000 Rabanne et al. ..... 340/573.4
6,150,921 A * 11/2000 Werb et al. ..... 340/10.1
6,297,737 B1 * 10/2001 Irvin ..... 340/539.32
6,362,738 B1 * 3/2002 Vega ..... 340/572.1
6,507,279 B2 * 1/2003 Loof ..... 340/572.1
6,693,537 B2 * 2/2004 Frank ..... 340/568.1
6,788,199 B2 * 9/2004 Crabtree et al. ..... 340/539.32
7,002,473 B2 * 2/2006 Glick et al. ..... 340/572.1
2002/0017998 A1 * 2/2002 Price ..... 340/573.1
2002/0097152 A1 * 7/2002 Mengrone et al. ..... 340/573.1
2004/0217859 A1 * 11/2004 Pucci et al. ..... 340/539.32
2005/0068168 A1 * 3/2005 Aupperle et al. ..... 340/825.49
2005/0148339 A1 * 7/2005 Boman et al. ..... 455/456.1

* cited by examiner

*Primary Examiner*—Thomas Mullen
(74) *Attorney, Agent, or Firm*—Schwegman, Lundberg & Woessner, P.A.

(57) ABSTRACT

A master controller for managing items tagged with radio-frequency identification (RFID) tags includes a transceiver to transmit interrogation signals to the RFID tags and to receive response signals from the RFID tags. The master controller may also include a processor to determine the proximity of tagged items based on signal levels of the response signals, and to notify a user when certain ones of the tagged items are in a predetermined relation to a proximity threshold.

48 Claims, 7 Drawing Sheets

400

| 402 RFID CODE | 404 ITEM DESCRIPTION | 406 PROFILE(S) | 408 ITEM PROXIMITY THRESHOLD (ft) |
|---|---|---|---|
| 0000000001 | COMPUTER | A,E | 5 |
| 0000000010 | WATCH | A,B,D | 5 |
| 0000000011 | AIRLINE TICKETS | B | 1 |
| 0000000100 | WALLET | A,B,D,E | 1 |
| 0000000101 | CAR KEYS | | 2 |
| ⋮ | ⋮ | ⋮ | ⋮ |
| | | | |
| | | | |
| | TOOL BOX/TOOLS | A | 8 |
| | SKIS | D5 | 10 |
| | SLEEPING BAG | D3 | 10 |
| | CLIMBING EQUIPMENT | D2 | 10 |
| | WATER BOTTLE | D1–D7 | 5 |
| | TACKLE BOX | D1 | 10 |
| | FISHING POLE | D1 | 10 |
| | BASEBALL BAT | D6 | 5 |
| | BASEBALL MIT | D6 | 5 |
| | GOLF CLUBS | D7 | 5 |
| | GOLF SHOES | D7 | 5 |

*Fig. 4A*

401

| 410 PROFILE CODE | 412 PROFILE DESCRIPTION | 414 PROFILE PROXIMITY THRESHOLD | 416 ALERT(?) | 418 PROFILE SELECTED? |
|---|---|---|---|---|
| A | WORK | | N | Y |
| B | TRAVEL | | Y | N |
| C | HOME | | N | N |
| D | RECREATION | | N | N |
| E | SCHOOL | | | |
| D1 | FISHING | | | |
| D2 | CLIMBING | | | |
| D3 | CAMPING | | | |
| D4 | HIKING | | | |
| D5 | SKIING | | | |
| D6 | BASEBALL | | | |
| D7 | GOLFING | | | |
| A1 | LEAVING WORK | | | |
| A2 | GOING TO WORK | | | |
| | | | | |
| | | | | |
| | | | | |
| | | | | |
| | | | | |

*Fig. 4B*

PROXIMITY MANAGEMENT SYSTEM AND METHOD USING RADIO-FREQUENCY IDENTIFICATION TAGS

TECHNICAL FIELD

Embodiments of the present invention pertain electronic communications and to radio-frequency identification (RFID) tags.

BACKGROUND

In today's society, people rely on many personal items for activities such as work, school, travel and recreation. Some of these personal items are sometimes misplaced causing a person to frantically search for a missing item before leaving for the activity. Some of these personal items are also forgotten causing a person to leave for an activity without the forgotten item.

For example, when leaving for work, a person may need to remember and locate a wallet, keys, laptop computer, employee badge, etc. For example, when leaving on a fishing trip, a person may need to remember and locate personal items associated with fishing, such as fishing poles, fishing net, tackle box, etc. Any one of these items may inadvertently be forgotten or may be difficult to locate.

Thus, what is needed is a system and method for identifying and locating items.

BRIEF DESCRIPTION OF THE DRAWINGS

The appended claims are directed to some of the various embodiments of the present invention. However, the detailed description presents a more complete understanding of embodiments of the present invention when considered in connection with the figures, wherein like reference numbers refer to similar items throughout the figures and:

FIG. 4A is an item table illustrating item descriptions and associated activity profiles in accordance with some embodiments of the present invention;

FIG. 4B is a profile table illustrating activity profiles in accordance with some embodiments of the present invention;

DETAILED DESCRIPTION

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. Embodiments of the invention set forth in the claims encompass all available equivalents of those claims. Embodiments of the invention may be referred to, individually or collectively, herein by the term "invention" merely for convenience and without intending to voluntarily limit the scope of this application to any single invention or inventive concept if more than one is in fact disclosed.

Figure 1A:
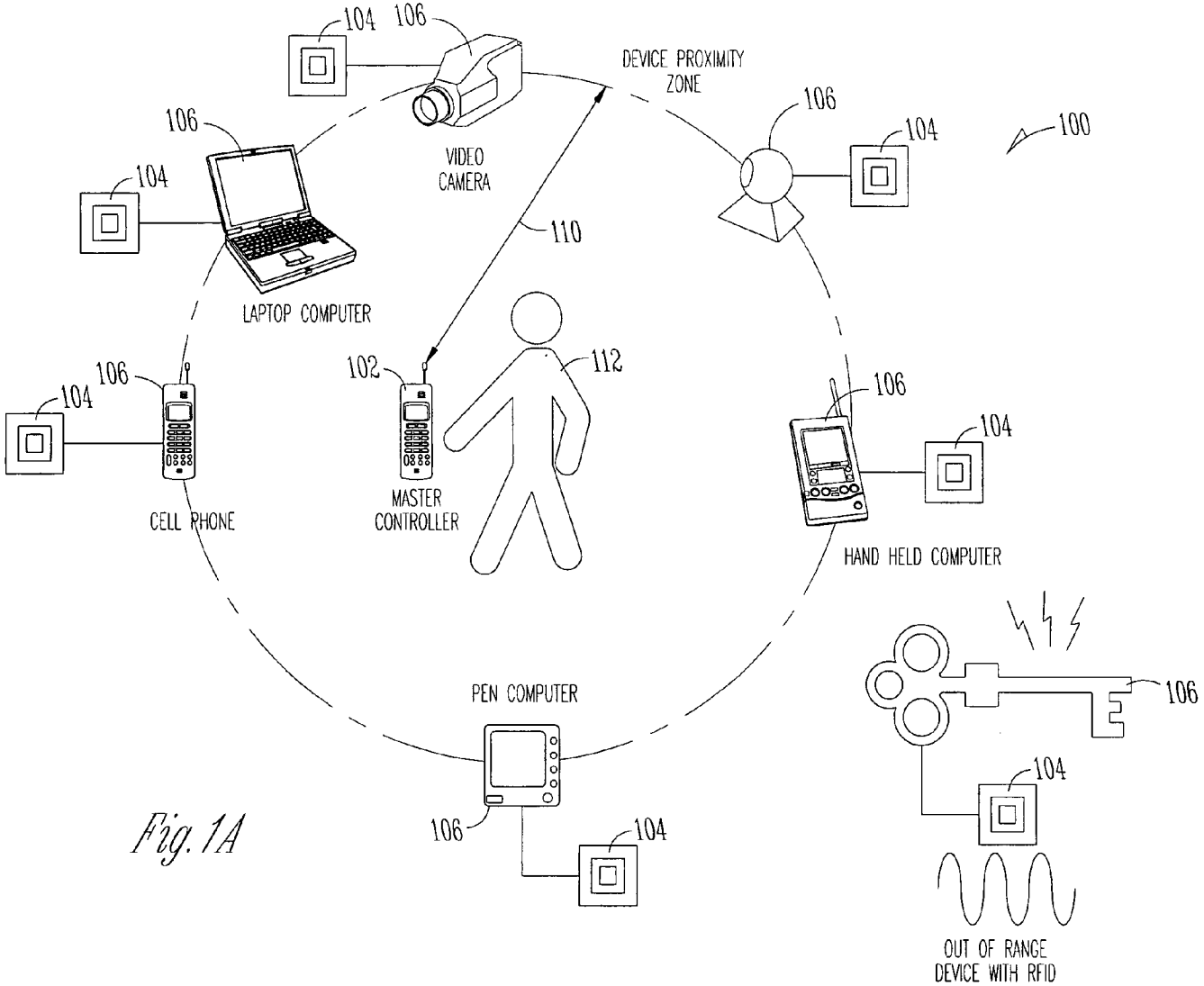
FIG. 1A is an item management system in accordance with some embodiments of the present invention.

FIG. 1A is an item management system in accordance with some embodiments of the present invention. Item management system 100 includes master controller 102 which may be used to manage items 106 by reading tags 104 associated with items 106. Items 106 may include personal and/or movable items that user 112 may desire to have or possess. Because these personal and/or movable items may easily be misplaced, lost or forgotten, system 100 may be used to help user 112 remember an item and/or find an item.

In some embodiments, system 100 includes a plurality of radio-frequency identification (RFID) tags 104. Each tag 104 may be associated with one item 106. Master controller 102 may have circuitry to determine the proximity of the tagged items based on signal levels of response signals. Master controller 102 may also have circuitry to notify user 112 when certain ones of the tagged items are outside proximity threshold 110. In some embodiments, master controller 102 may use a received signal strength indicator (RSSI) to determine when tagged items are outside proximity threshold 110. In some embodiments, the circuitry for performing various operations by master controller 102 may include a combination of software, firmware and/or logic circuitry operating with a processing system, although the scope of the invention is not limited in this respect. In some embodiments, a notification may be provided when certain items are within a proximity threshold, although the scope of the invention is not limited in this respect.

For example, when a user is preparing to go somewhere, say to work, the user conventionally searches around looking for personal items that the user wishes to take along. These items may include, for example, a personal digital assistant (PDA), a mobile telephone, a laptop computer, keys, wallet, pens, bus passes, employee badge, etc. The user may spend time looking for these items, and in some cases, may simply forget some items. Through the use of system 100, the user may no longer have to search for items and can easily determine if any items have been forgotten. In accordance with embodiments of the present invention, a user may be notified by master controller 102 when a managed item is left behind or not within close proximity. This allows the user to focus attention on other things. In some embodiments, master controller 102 may be an integral part of the user's wireless telephone or PDA so that the user doesn't have to carry an extra device. Accordingly, system 100 may allow a user to determine when something is forgotten, what has been forgotten, and where that something is located.

In accordance with some embodiments, RFID tags 104 may be affixed or adhered to items 106 during an initializing process which is described in more detail below. In some embodiments, master controller 102 maintains a list of items 106 nearby (i.e., within communication range) by regularly transmitting an interrogation signal to tags 104, and may further maintain a list of the items that are within proximity threshold 110.

Each RFID tag 104 may have a unique identification code associated with the tag, and each tag may generate a response signal in response to an interrogation signal transmitted by a transceiver of master controller 102. The response may include the unique identification code associated with RFID tag 104, allowing the master controller to uniquely identify the tag and the associated item. Furthermore, in some embodiments, master controller 102 may be able to determine the range of the tagged item from the signal level of the response signal.

In some embodiments, master controller 102 may perform a collision avoidance algorithm to distinguish between response signals received substantially simultaneously from more than one of the RFID tags that are being interrogated, although the scope of the invention is not limited in this respect.

In some embodiments, master controller 102 may include a storage location or memory element to store a database. The database may include the unique identification code of each of RFID tags 104, a description of the associated items 106, and proximity threshold 110, which may be associated with each item 106, although the scope of the invention is not limited in this respect. In some embodiments, the database may further include one or more activity profiles associated with each item 106. Each activity profile may represent an activity that may be engaged in by user 112. In these embodiments, certain one of items 106 associated with a particular activity profile may be desired by user 112 for an associated activity.

Figure 1B:
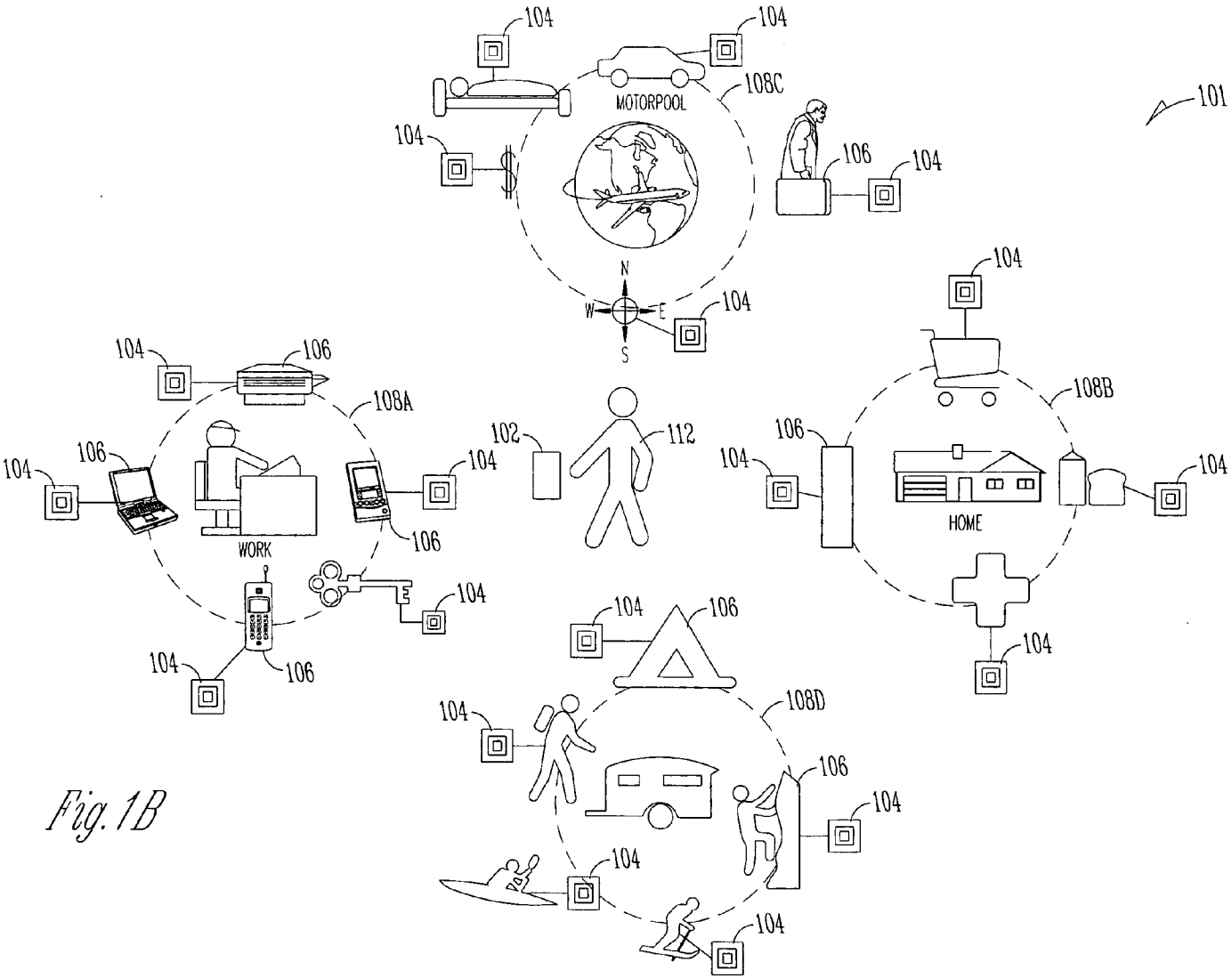
FIG. 1B is an item management system with activity profiles in accordance with some embodiments of the present invention.

FIG. 1B is an item management system with activity profiles in accordance with some embodiments of the present invention. Item management system 101 illustrates items 106 associated with one or more activity profiles 108. In these embodiments, user 112 may select one of the activity profiles, and master controller 102 may determine which items 106 associated with the selected profile are not within a proximity threshold for the selected profile. In some embodiments, master controller 102 may alert user 112 with an alert and may display one or more of items 106 associated with the selected profile that are not within the proximity threshold. In some embodiments, master controller 102 may further determine when one of the items 106 that was not within the proximity threshold for the selected profile comes into the proximity threshold for the selected profile and may provide an alert to user 112.

In some embodiments, master controller 102 may further comprise a graphical user interface (GUI) to allow a selection of one of the profiles by user 112. The GUI may be used to receive additional item descriptions and to assign profiles and RFID tag identification codes to items 106. In some embodiments, the GUI may display a description of items of the selected profile that are outside the proximity threshold for the selected activity profile. In some embodiments, master controller 102 notifies user 112 with an alert when items of the selected profile are outside the proximity threshold for the selected profile. In some embodiments, the alert may be an audio alert (e.g., a beep or other sound), a visual alert, a mechanical alert (e.g., a vibration) and/or a remote alert (e.g., an email or message service alert), although the scope of the invention is not limited in this respect.

In some embodiments, the profiles may comprise work profile 108*a*, at-home profile 108*b*, travel profile 108*c*, and/or recreation profile 108*d*. In these embodiments, items 106 associated with work profile 108*a* may include items used for work, items 106 associated with at-home profile 108*b* may include items used at home, items 106 associated with travel profile 108*c* may include items used when traveling, and items 106 associated with recreation profile 108*d* may include items used for recreation. Work profile 108*a*, at-home profile 108*b*, travel profile 108*c*, and/or recreation profile 108*d* are examples of some activity profiles that may be used, however the scope of the invention is not limited in this respect as other profiles are equally suitable. Examples of some other activity profiles may include a school profile, as well as specific recreation profiles such as camping, fishing, hiking and climbing profiles.

In some embodiments, master controller 102 may be programmable to automatically select one of the profiles. The automatic selection may be based on a time-of-day, a day-of-week and/or a location. For example, during weekdays at, say 8:00 am, the work profile may automatically be selected, while on weekends, a recreation profile may automatically be selected. In some embodiments, a going-to-work profile may automatically be selected at a certain time (e.g., 8:00 am) on weekday mornings, while a leaving-work profile may automatically be selected at a certain time (e.g., 5:00 pm) on weekday afternoons. In some embodiments, a profile may automatically be selected based on the location of master controller 102. For example, when master controller 102 determines that it is located at work, the at-work profile may automatically be selected. In these embodiments, master controller 102 may include a location determining system, such as a geolocation system (e.g., a global positioning system (GPS) system), although the scope of the invention is not limited in this respect.

In some embodiments, user 112 may select one of the profiles through the GUI, master controller 102 may determine which items 106 associated with the selected profile are not within a proximity threshold for the selected profile and master controller 102 may alert user 112 with an alert. In some embodiments, master controller 102 may display items 106 on the GUI associated with the selected profile that are not within the proximity threshold. In some embodiments, master controller 102 may also determine when one of items 106 that was not within the proximity threshold for the selected profile comes into the proximity threshold for the selected profile and may provide an alert to user 112. In some embodiments, user 112 may be able to locate the items that are not within the proximity threshold for the profile by changing the location of master controller 102 (e.g., by moving around). In some embodiments, user 112 may monitor a signal strength indicator displayed on the GUI for a particular item to determine the missing item's location.

In some embodiments, user 112, through the GUI, may select the items that are not within the proximity threshold for the selected profile, and master controller 102 may alert user 112 when one of the items that was not within the proximity threshold comes within range. This alert may be distinguishable from the alert used for notifying user 112 when items are outside the proximity threshold, although the scope of the invention is not limited in this respect.

In some embodiments, RFID tags 104 comprise passive RFID tags, while in other embodiments, the RFID tags may comprise active tags. These embodiments are discussed in more detail below.

In some embodiments, RFID tags 104 may be affixed to personal items that may be misplaced by persons needing assistance, such as the elderly or infirm. For example, such items may include eyeglasses, artificial teeth replacements (e.g., dentures), drugs, hearing aids, etc. In some embodiments, the proximity threshold may be adjustable, such as between 10 meter, 3 meter and 1 meter, to allow a user to quickly locate the missing personal item. In some embodiments, the user may be a person assigned to help find the misplaced or missing items of another, for example, in the case of the elderly or infirm.

Figure 2:
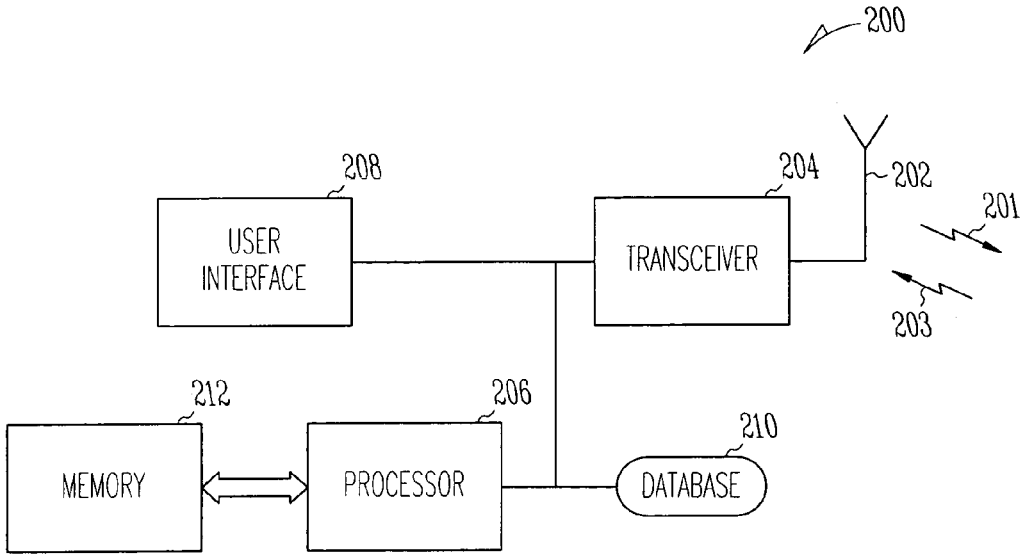
FIG. 2 is a block diagram of a master controller in accordance with some embodiments of the present invention.

FIG. 2 is a block diagram of a master controller in accordance with some embodiments of the present invention. Master controller 200 may be suitable for use as master controller 102 (FIG. 1A and FIG. 1B), although other configurations for master controllers may also be suitable. Master controller 200 comprises transceiver 204 to transmit interrogation signals 201 to RFID tags and to receive response signals 203 from the RFID tags. Master controller 200 may also comprise processor 206 to determine the proximity of tagged items based on signal levels of the response signals. In some embodiments, a received signal strength indicator (RSSI) may be used to determine the proximity of the RFID tags, although the scope of the invention is not limited in this respect. In some embodiments, processor 206 may notify a user when certain ones of the tagged items are outside a proximity threshold.

In some embodiments, master controller 200 includes memory 212 which may maintain a list of items nearby (i.e., within communication range but not necessarily within a proximity threshold) by regularly transmitting interrogation signal 201. In these embodiments, master controller 200 may maintain a list of the items that are within a proximity threshold, although the scope of the invention is not limited in this respect.

In some embodiments, processor 206 may perform a collision avoidance algorithm to distinguish between response signals received substantially simultaneously from more than of the RFID tags being interrogated.

In some embodiments, master controller 200 may further comprise antenna 202 coupled to transceiver 204. Antenna 202 may be selected to have characteristics based on a frequency range of RFID tags 104 (FIG. 1). Antenna 202 may comprise a directional or omnidirectional antenna, including, for example, a dipole antenna, a monopole antenna, a loop antenna, a microstrip antenna or other type of antenna suitable for the transmission and/or reception of radio frequency signals with RFID tags 104 (FIG. 1). In some embodiments, antenna 202 may be a patch or a coil antenna, although the scope of the invention is not limited in this respect. In some embodiments, when antenna 202 is a patch antenna, the patch antenna may comprise a solid piece of metal or foil. In some embodiments, when antenna 202 is a directional antenna, its directivity may be used to help locate managed items.

In some embodiments, master controller 200 may further comprise a storage location to store database 210. Database 210 may include the unique identification codes of the RFID tags, a description of the associated items, and in some embodiments, a proximity threshold associated with each item. In some embodiments, database 210 may further comprise one or more profiles associated with each item. Each profile may represent an activity that may be engaged in by the user. The items associated with a particular profile may be desired by the user for an associated activity.

In some embodiments, master controller 200 may include user interface 208. User interface 208 may, among other things, allow the selection of one of the profiles by the user, may receive additional item descriptions (e.g., the items inside the proximity threshold), and may be used to assign profiles and RFID tag identification codes to the items. In some embodiments, user interface 208 may further display a description of items of the selected profile that are outside the proximity threshold, although the scope of the invention is not limited in this respect. In some embodiments, a user may interface with master controller 200 and select profiles by voice activation. User interface 208 may be any type of display or user interface including a graphical user interface (GUI), although the scope of the invention is not limited in this respect.

In some embodiments, a user may select one of the profiles through user interface 208, processor 206 may determine which items associated with the selected profile are not within a proximity threshold for the selected profile and may alert the user with an alert. In some embodiments, user interface 208 may display the items associated with the selected profile that are not within the proximity threshold. In some embodiments, master controller 200 may be programmable to automatically select one of the profiles. In some embodiments, the automatic selection of profiles may be based on a time-of-day, a day-of-week and/or a location of the master controller.

In some embodiments, processor 206, based on a signal strength of return signals 203, may determine when one of the items that were not within the proximity threshold for the selected profile comes into the proximity threshold for the selected profile and may provide an alert to the user.

In some embodiments, master controller 200 may be part of (or integrated into) a wireless communication device, such as a cellular or wireless telephone, a personal digital assistant (PDA) or a handheld portable communication device, although the scope of the invention is not limited in this respect. In some embodiments, the wireless communication device may be a laptop or portable computer with wireless communication capability, a web tablet, a pager, an instant messaging device, a digital camera, an access point or other device that may receive and/or transmit information wirelessly. In some embodiments, the wireless communication device may transmit and/or receive RF communications in accordance with specific communication standards, such as the Institute of Electrical and Electronics Engineers (IEEE) standards including IEEE 802.11(a), 802.11(b), 802.11(g/h) and/or 802.11(n) standards for wireless local area networks (WLANs) and/or 802.16 standards for wireless metropolitan area networks (WMANs), although the wireless communication device may also be suitable to transmit and/or receive communications in accordance with other techniques including the Digital Video Broadcasting Terrestrial (DVB-T) broadcasting standard, and the High performance radio Local Area Network (HiperLAN) standard.

Although for some embodiments, master controller 200 is described as being part of a wireless communication device, master controller 200 may be a stand-alone device, while in other embodiments, master controller may part of almost any wireless and/or wireline communication device, including a general purpose processing or computing system. In some embodiments, master controller 200 may part of be a battery-powered device, although the scope of the invention is not limited in this respect.

Although master controller 200 is illustrated as having several separate functional elements, one or more of the functional elements may be combined and may be implemented by combinations of software-configured elements, such as processing elements including digital signal processors (DSPs), and/or other hardware elements. For example, processing elements may comprise one or more microprocessors, DSPs, application specific integrated circuits (ASICs), and combinations of various hardware and logic circuitry for performing at least the functions described herein.

Figure 3:
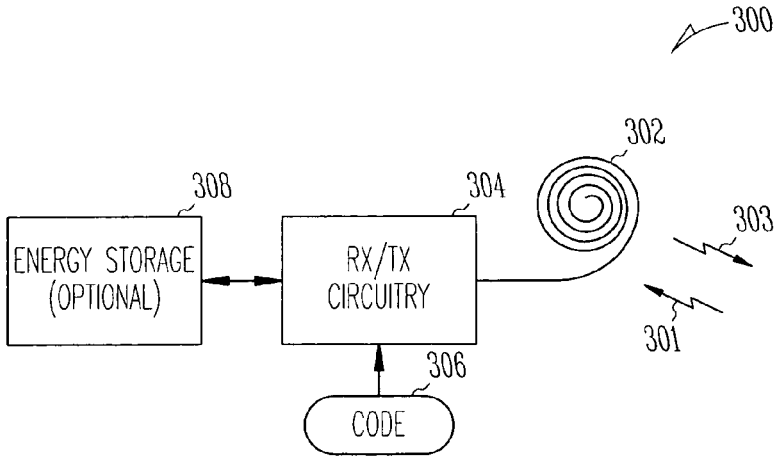
FIG. 3 is a block diagram of a radio-frequency identification (RFID) tag suitable for use with some embodiments of the present invention.

FIG. 3 is a block diagram of a radio-frequency identification (RFID) tag suitable for use with some embodiments of the present invention. RFID tag 300 may be suitable for use as one or more of tags 104 (FIG. 1), although other tags may also be suitable. RFID tag 300 may include antenna 302 to receive interrogation signals 301 and transmit response signals 303. Interrogation signals 301 may correspond to interrogation signals 201 (FIG. 2), and response signals 303 may correspond to response signals 203 (FIG. 2). RFID tag 300 may also include transceiver circuitry 304 for receiving interrogation signals 301 from antenna 302, and for transmitting response signals 303. Each RFID tag 300 may have unique identification code 306 associated therewith. Antenna 302 may be a coil antenna, although other antennas may also be suitable.

RFID tag 300 may generate response signal 303 in response to interrogation signal 301 transmitted by master controller 102 (FIG. 1). Response signal 303 may include unique identification code 306 associated with the particular RFID tag.

In some embodiments, RFID tag 300 may comprise a passive RFID tag. In these embodiments, the passive RFID tags may use current induced on antenna 302 by interrogation signal 301 to generate the response signal 303. In some embodiments, when RFID tag 300 is a passive tag, no battery is generally included as part of the tag. In these embodiments, interrogation signal 301 may induce a current on antenna 302 to power transceiver circuitry 304 allowing transceiver circuitry 304 to transmit the tag's unique code 306 as part of response signal 303. In some embodiments, passive RFID tags may include a capacitive storage element (e.g., storage element 308) which may temporarily store some energy generated from interrogation signal 301.

In some embodiments, RFID tag 300 may comprise an active RFID tag. In these embodiments, the active RFID tag may use an internal power source to generate response signal 303 in response to interrogation signal 301. In some embodiments, when RFID tag 300 is an active tag, a battery or other energy storage element may be included as part of the tag (e.g., energy storage element 308). In these embodiments, energy storage element 308 may power transceiver circuitry 304 to allow transceiver circuitry 304 to transmit the tag's unique code 306 as part of response signal 306. In some embodiments, systems that use active tags may have greater proximity thresholds than systems that use passive RFID tags because response signal 303 generated by an active tag may be more powerful than signals generated by a passive tag. In some embodiments, the proximity thresholds of systems using active RFID tags may be up to 100 feet and even greater. In some embodiments, RFID tag 300, whether active or passive, may include a built-in memory, although the scope of the invention is not limited in this respect.

Systems 100 and 101 (FIGS. 1A and 1B) may use either active or passive tags, or any combination of active and passive tags. In some embodiments, RFID tag 300 comprises a low-frequency tag operating at frequencies of ranging between 100 and 150 kHz. In some embodiments, a low-frequency tag may operate at approximately 125 kHz, although the scope of the invention is not limited in this respect.

In some embodiments, RFID tag 300 comprises a high-frequency tag operating at frequencies ranging between approximately 10 and 15 MHz. In some embodiments, a high-frequency tag may operate at 13.56 MHz and may have a proximity threshold of about 10 feet, although the scope of the invention is not limited in this respect.

In some embodiments, RFID tag 300 comprises an ultra-high-frequency tag operating at frequencies ranging between approximately 800 and 1000 MHz. In some embodiments, the ultra-high-frequency tag may operate at frequencies ranging from approximately 866 to 930 MHz, although the scope of the invention is not limited in this respect.

In some embodiments, RFID tag 300 may comprise a microwave frequency tag operating at microwave frequencies ranging between approximately 5 and 6 GHz. In some embodiments, the microwave frequency tag may operate at frequencies of approximately 5.8 GHz and may having a proximity threshold of up to 30 feet, although the scope of the invention is not limited in this respect.

FIG. 4A is an item table illustrating item descriptions and associated activity profiles in accordance with some embodiments of the present invention. Item table 400 may be part of database 210 (FIG. 2) and may be accessible to master controller 200 (FIG. 2). Table 400 may include unique identification codes 402 of the RFID tags, descriptions 404 of the associated items, and in some embodiments, proximity threshold 408 associated with each item. In some embodiments, table 400 may further identify one or more profiles 406 associated with each item. Each profile may represent an activity that may be engaged in by the user. The items associated with a particular profile may be desired by the user for an associated activity. In some embodiments, profiles 406 may be identified by a profile code further defined in a profile table described below. In some embodiments, table 400 may be stored in master controller 200 (FIG. 2), while in other embodiments, table 400 may be stored in an external database which may reside on some other system other than master controller 200 (FIG. 2).

FIG. 4B is a profile table illustrating activity profiles in accordance with some embodiments of the present invention. Profile table 401 may also be part of database 210 (FIG. 2) and may be stored in master controller 200 (FIG. 2). Profile table 401 may describe activity profiles 406 (FIG. 4A) used in table 400 (FIG. 4A) and may include profile codes 410 and associated descriptions 412. In some embodiments, each profile may include proximity threshold 414. In some embodiments, item proximity thresholds 408 (FIG. 4A) may be set for individual items and listed table 400 (FIG. 4A), and profile proximity thresholds 414 may be set for activity profiles and listed in table 401.

In some embodiments, profile table 401 may include alert setting 416 for each activity profile. The alert setting may be set by the user when a profile is selected and may indicate to the master controller when to provide an alert when one or more items associated with the selected profile are outside the proximity threshold for the profile. In some embodiments, profile table 401 may include profile selection setting 418. The profile selection setting may indicate when the associated profile is selected. In some embodiments, alert setting 416 may also indicate the type of alert.

In some embodiments, the profiles may include a work profile, an at-home profile, a travel profile, and a recreation profile. Items described in column 404 may be associated with more than one profile. Items associated with the work profile may include items used for work, items associated with the at-home profile may include items used at home, items associated with the travel profile may include items used when traveling, and items associated with the recreation profile may include items used for recreation.

In some embodiments, a user may create additional profiles for specific activities. For example, a user may create a school profile to associate items used for school, a fishing profile to associate items used for fishing, a camping profile to associate items used for camping, etc. These additional profiles may be viewed as separate profiles, while in some embodiments; they may be viewed as sub-profiles of other activity profiles.

In some embodiments, a user may select proximity thresholds for items and/or profiles based on distance (e.g. feet or meters), while in other embodiments, a user may select proximity threshold for items and/or profiles based on a return signal level. In some embodiments, proximity thresholds may be selected based on the range of the RFID tag associated with the item, as well as the type of item. In some embodiments, the master controller may provide guidance to the user in selecting proximity thresholds for items based on the type of item and the range of the tag, although the scope of the invention is not limited in this respect.

Figure 5:
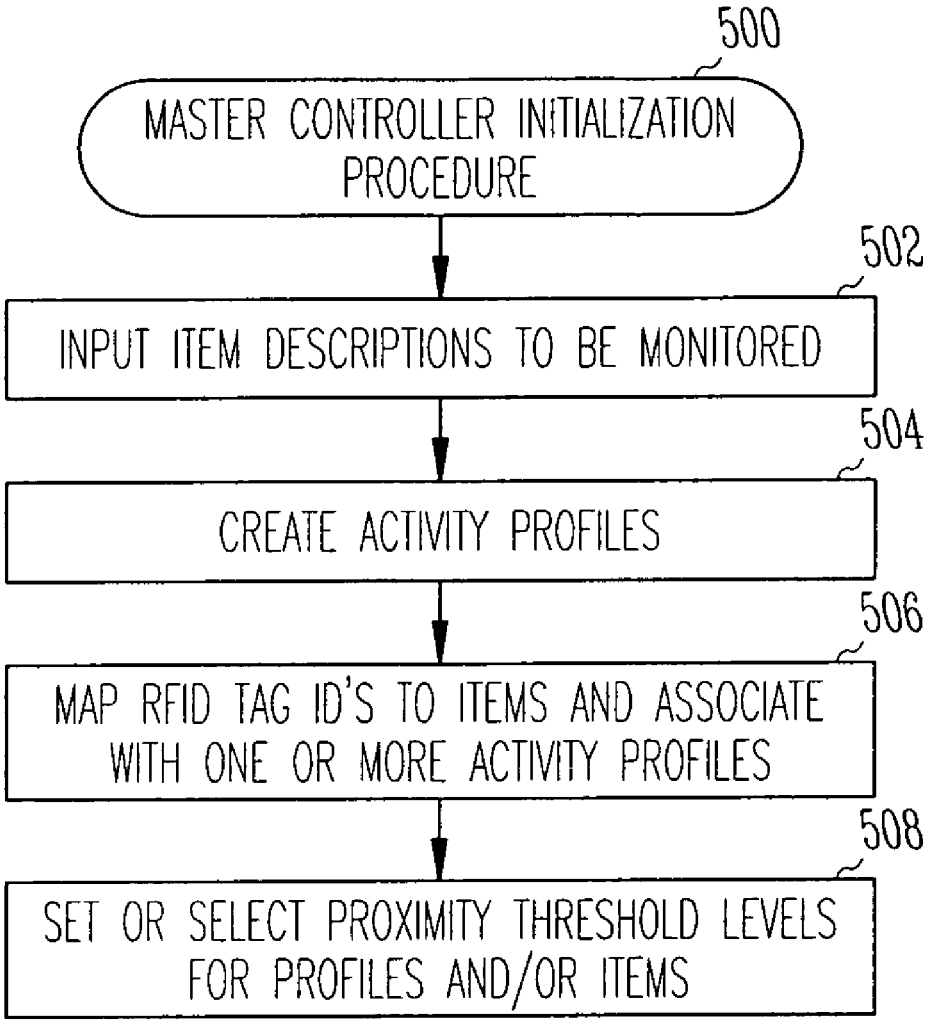
FIG. 5 is a flow chart of a master controller initialization procedure in accordance with some embodiments of the present invention.

FIG. 5 is a flow chart of a master controller initialization procedure in accordance with some embodiments of the present invention. Procedure 500 may be preformed by a master controller, such as master controller 102 (FIGS. 1A and 1B), although other systems may also be used to perform procedure 500. Procedure 500 may be used to initialize a master controller for performing an item management procedure, such as procedure 600 (FIG. 6) described below.

Operation 502 comprises inputting item descriptions to be monitored. For example, item descriptions 404 (FIG. 4A) described in table 400 (FIG. 4A) may be input during operation 502.

Operation 504 comprises creating activity profiles. Operation 504 may be performed for embodiments of the present invention that use activity profiles. Operation 504 may be skipped for embodiments that do not use activity profiles.

Operation 506 comprises mapping RFID tags to items. Operation 506 may comprise inputting or reading RFID tag codes, such as code 306 (FIG. 3), into the master controller. In some embodiments, a tag reader may be used. For example, transceiver 204 (FIG. 2) of the master controller may read RFID tag codes and the user may associate a tag with one of the item descriptions. In some embodiments, operation 506 may also include affixing or adhering the RFID tags to the items. In some embodiments, operation 506 comprises associating items with one or more activity profiles created in operation 504. In some embodiments, operation 506 may comprise specifying the type of RFID tag associated with an item. The type of tag may, for example, be specified by the user, or in some cases, may be determined by the tag reader when reading the RFID tag codes.

In some embodiments, operations 502, 504 and 506 comprise generating a database, such as database 210 (FIG. 2), to include the unique identification code of the RFID tags, a description of an associated item, and a proximity threshold associated with each item. In some embodiments, the database may be generated using a graphical user interface, such as user interface 208 (FIG. 2), and stored in the master controller.

In some embodiments, operations 502, 504 and 506 may further include generating the database to include one or more activity profiles associated with each item. In these embodiments, each activity profile may represent an activity that a user may engage in. Items associated with a particular activity profile may be desired by the user for an associated activity, Operation 508 comprises setting proximity threshold levels for the items and/or the activity profiles. In some embodiments, proximity thresholds may be set based on the type of tag and/or the item associated with the tag.

Figure 6:
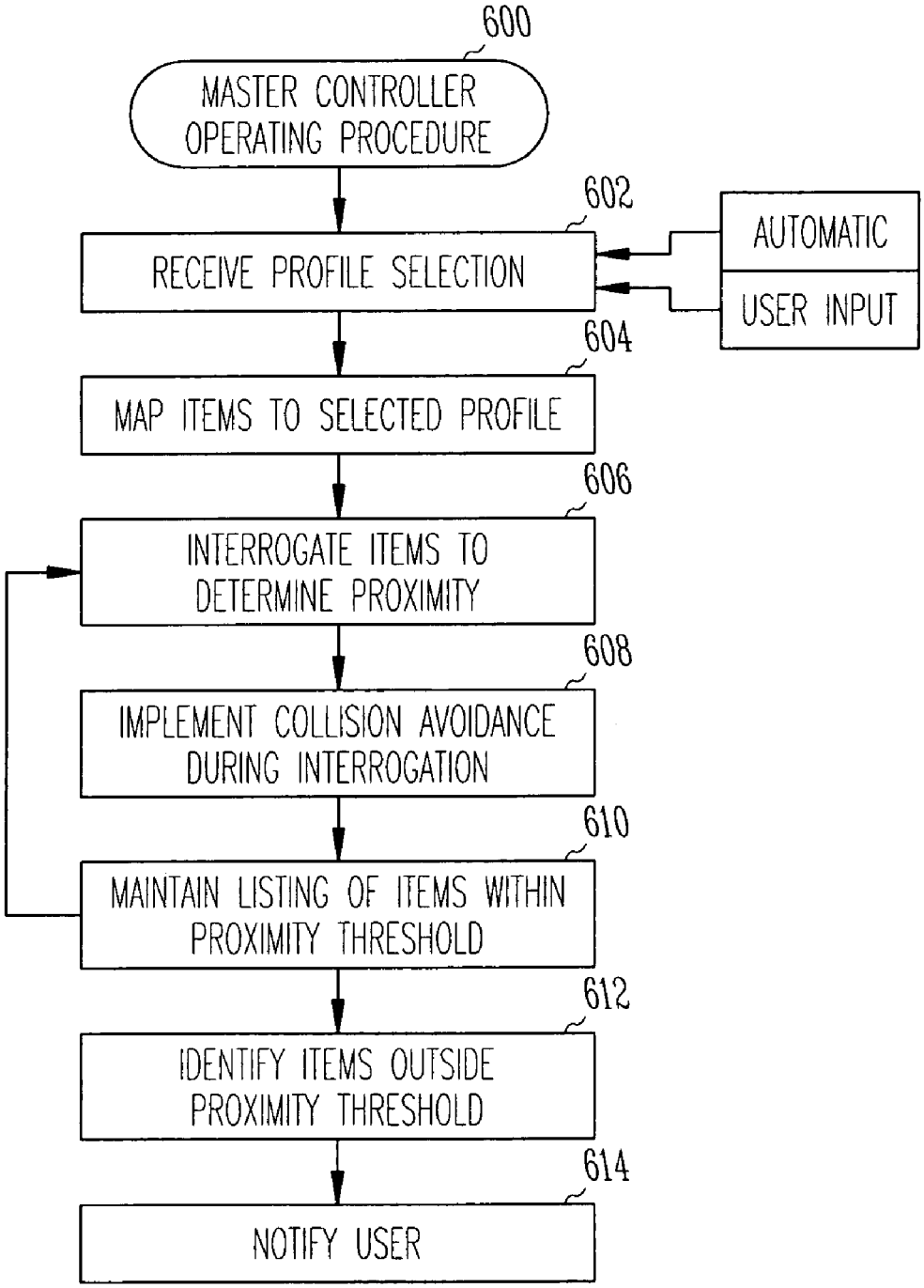
FIG. 6 is a flow chart of a master controller operating procedure in accordance with some embodiments of the present invention.

FIG. 6 is a flow chart of a master controller operating procedure in accordance with some embodiments of the present invention. Master controller operating procedure 600 may be performed by a master controller, such as master controller 102 (FIGS. 1A and 1B), for managing a plurality of items tagged with RFID tags.

Operation 602 comprises receiving an activity profile selection. In some embodiments, the profile selection may be automatic. In some embodiments, the profile selection may be received from user. Examples of some activity profiles are illustrated in table 401 (FIG. 4B). In some embodiments, operation 602 may comprise receiving a selection of one of the profiles by the user through user interface 208 (FIG. 2). In some embodiments, operation 602 may comprise automatically selecting one of the activity profiles based on a time-of-day, a day-of-week and/or location. In some embodiments, operation 602 comprises automatically selecting one of the activity profiles based on a geographic location.

Operation 604 comprises mapping items to the selected profile. In some embodiments, operation 604 may comprise analyzing or sorting a table, such as table 400 (FIG. 4A) to determine which items are associated with the selected activity profile. In some embodiments of the present invention that do not use activity profiles, operations 602 and 604 may be skipped.

Operation 606 comprises interrogating the RFID tags of tagged items to determine an item's proximity. In some embodiments, operation 606 comprises transmitting an interrogation signal, such as signal 201 (FIG. 2) to be received by the RFID tags, and receiving the response signals, such as response signal 203 (FIG. 2). Each response signal may include a unique identification code associated with one of the RFID tags. In some embodiments, operation 606 may be performed in response to user input. In some embodiments, operation 606 may be performed automatically based on time-of-day, day-of-week and/or location depending on the profile selection of operation 602.

Operation 608 comprises performing a collision avoidance algorithm to distinguish between response signals received substantially simultaneously from more than one of the RFID tags. In some embodiments, the collision avoidance algorithm may be performed by processor 206 (FIG. 2).

Operation 610 comprises maintaining a list of items within the proximity threshold. Operation 612 comprises identifying items outside of a proximity threshold. In some embodiments, a received signal strength indicator (RSSI) of return signals may be used to determine when tagged items are outside the proximity threshold.

Operation 614 comprises notifying a user when one or more of the RFID tagged items is outside a proximity threshold. In some embodiments in which an activity profile is selected, operation 614 comprises notifying a user when one or more of the RFID tagged items of the selected activity profile is outside a proximity threshold associated with the activity profile. In some embodiments, the alert may be an audio alert (e.g., a beep or other sound), a visual alert, a mechanical alert (e.g., a vibration) and/or a remote alert (e.g., an email or message service alert), although the scope of the invention is not limited in this respect.

In some embodiments, operation 612 comprises determining the proximity of the tagged items based on signal levels of response signals, and operation 614 comprises notifying the user when certain ones of the tagged items are outside a proximity threshold based on the signal levels.

In some embodiments, operation 614 comprises displaying (e.g., on a GUI or other user display or user interface device) a description of items of the selected profile that are determined to be outside the proximity threshold. In some embodiments, operation 612 comprises displaying a signal strength indicator for one or more of the tagged items and notifying the user when one or more of the RFID tagged items that was outside the proximity threshold is within the proximity threshold. In some embodiments, the user may select to have managed items within the proximity threshold displayed, as well as select to have managed items outside the proximity threshold displayed. In some embodiments, the user may select to be notified when managed items are within their proximity threshold (instead of outside the proximity threshold).

In some embodiments, operations 606-610 may be performed on a regular basis to monitor the proximity of tagged items. Although the individual operations of procedures 500 and 600 are illustrated and described as separate operations, one or more of the individual operations may be performed concurrently, and nothing requires that the operations be performed in the order illustrated.

Unless specifically stated otherwise, terms such as processing, computing, calculating, determining, displaying, or the like, may refer to an action and/or process of one or more processing or computing systems or similar devices that may manipulate and transform data represented as physical (e.g., electronic) quantities within a processing system's registers and memory into other data similarly represented as physical quantities within the processing system's registers or memories, or other such information storage, transmission or display devices. Furthermore, as used herein, computing device includes one or more processing elements coupled with computer-readable memory that may be volatile or non-volatile memory or a combination thereof.

Embodiments of the invention may be implemented in one or a combination of hardware, firmware and software. Embodiments of the invention may also be implemented as instructions stored on a machine-readable medium, which may be read and executed by at least one processor to perform the operations described herein. A machine-readable medium may include any mechanism for storing or transmitting information in a form readable by a machine (e.g., a computer). For example, a machine-readable medium may include read-only memory (ROM), random-access memory (RAM), magnetic disk storage media, optical storage media, flash-memory devices, electrical, optical, acoustical or other form of propagated signals (e.g., carrier waves, infrared signals, digital signals, etc.), and others.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, invention may lie in less than all features of a single disclosed embodiment. Thus the following claims are hereby incorporated into the detailed description, with each claim standing on its own as a separate preferred embodiment.

What is claimed is:

1. A system for managing items comprising:

a master controller; and a plurality of radio-frequency identification (RFID) tags, wherein each tag is associated with one of a plurality of managed items, wherein the master controller determines the proximity of the managed items within communication range based on signal levels of response signals generated by the RFID tags in response to interrogation signals and provides a notification when certain ones of the items are within a proximity threshold, the proximity threshold being less than the communication range, and wherein the master controller has access to a storage location which includes a database, the database comprising unique identification codes of the RFID tags, a description of the associated items, and a proximity threshold associated with each item.

2. The system of claim 1 wherein each tagged item has an associated proximity threshold, and wherein the master controller determines the proximity of the managed items based on signal levels of response signals and provides the notification when certain ones of the tagged items are outside the associated proximity threshold.

3. The system of claim 1 wherein each tagged item has an associated proximity threshold, and wherein the master controller determines the proximity of the managed items based on signal levels of response signals and provides the notification when certain ones of the tagged items are inside or at the associated proximity threshold.

4. The system of claim 1 wherein the master controller comprises a transceiver, wherein the items are personal, movable items, wherein each RFID tag has a unique identification code associated therewith, wherein the RFID tags generate a response signal in response to an interrogation signal transmitted by the transceiver, the response signal to include the unique identification code associated with the RFID tag.

5. The system of claim 4 wherein the master controller further comprises an antenna coupled to the transceiver comprising either a patch or a coil antenna, the antenna selected to have characteristics based on a frequency range of the RFID tags.

6. The system of claim 4 wherein the RFID tags comprise passive RFID tags, the passive RFID tags to use current induced on an antenna by the interrogation signal to generate the response signal.

7. The system of claim 4 wherein the RFID tags comprise active RFID tags, the active RFID tags to use an internal power source to generate the response signal in response to the interrogation signal.

8. The system of claim 1 wherein the master controller includes the storage location therein.

9. The system of claim 8 wherein the database further comprises one or more profiles associated with each item, each profile representing an activity.

10. The system of claim 9 wherein the master controller further comprises a graphical user interface (GUI) to allow a selection of one of the profiles, to receive additional item descriptions, to assign a proximity threshold to either individual items or a profile, and to assign profiles and RFID tag identification codes to the items, the GUI to further display a description of items of the selected profile that are outside an associated proximity threshold.

11. The system of claim 10 wherein the profiles comprise at least one of a work profile, an at-home profile, a travel profile, and a recreation profile, and wherein items associated with the work profile include items used for work, wherein items associated with the at-home profile include items used at home wherein items associated with the travel profile include items used when traveling, and wherein items associated with the recreation profile include items used for recreation.

12. The system of claim 10 wherein the master controller is programmable to automatically select one of the profiles based on at least one of a time-of-day, a day-of-week and a geographic location of the master controller.

13. The system of claim 10 wherein the master controller further comprises a processor, wherein when one of the profiles is selected through the GUI, the processor instructs the transceiver to determine which items associated with the selected profile are not within a proximity threshold for the selected profile, provides an alert, and instructs the GUI to display the items associated with the selected profile that are not within the proximity threshold.

14. The system of claim 13 wherein the processor, based on input from the transceiver, further determines when one of the items that was not within the proximity threshold for the selected profile comes into the proximity threshold for the selected profile and provides an alert.

15. A system for managing items comprising:

a master controller; and a plurality of radio-frequency identification (RFID) tags, wherein each tag is associated with one of a plurality of managed items, wherein the master controller determines the proximity of the managed items within communication range based on signal levels of response signals generated by the RFID tags in response to interrogation signals and provides a notification when certain ones of the items are within a proximity threshold, the proximity threshold being less than the communication range, wherein each tagged item has an associated proximity threshold, and, wherein the master controller includes a processor and transceiver to maintain a list of items within communication range by regularly transmitting an interrogation signal and to further maintain a list of the items that are within the associated proximity threshold, the proximity threshold for each tagged item being less than the communication range.

16. A system for managing items comprising:

a master controller; and a plurality of radio-frequency identification (RFID) tags, wherein each tag is associated with one of a plurality of managed items, wherein the master controller determines the proximity of the managed items within communication range based on signal levels of response signals generated by the RFID tags in response to interrogation signals and provides a notification when certain ones of the items are within a proximity threshold to the master controller, the proximity threshold being less than the communication range, wherein the master controller further comprises a transceiver, wherein the items are personal, movable items, wherein each RFID tag has a unique identification code associated therewith, wherein the RFID tags generate a response signal in response to an interrogation signal transmitted by the transceiver, the response signal to include the unique identification code associated with the RFID tag, and wherein the master controller comprises a processor to perform a collision avoidance algorithm to distinguish between response signals received substantially simultaneously from more than one of the RFID tags being interrogated.

17. The system of claim 16 wherein the processor further determines the proximity of the tagged items and provides the notification.

18. The system of claim 17 wherein the processor displays a received signal strength indicator based on return signals of a selected one of the managed items.

19. A master controller for managing a plurality of managed items tagged with radio-frequency identification (RFID) tags, the master controller comprising:

a transceiver to transmit interrogation signals to RFID tags and to receive response signals from the RFID tags within communication range; and a processor to determine the proximity of the managed items based on signal levels of the response signals, and to provide a notification when certain ones of the managed items are within a proximity threshold, the proximity threshold being less than the communication range, wherein the master controller has access to a storage location which includes a database, the database comprising unique identification codes of the RFID tags, a description of the associated items, and a proximity threshold associated with each item.

20. The master controller of claim 19 wherein each tagged item has an associated proximity threshold, and wherein the processor determines the proximity of the managed items based on signal levels of response signals and provides the notification when certain ones of the tagged items are outside the associated proximity threshold.

21. The master controller of claim 19 wherein each tagged item has an associated proximity threshold, and wherein the processor determines the proximity of the managed items based on signal levels of response signals and provides the notification when certain ones of the tagged items are inside or at the associated proximity threshold.

22. The master controller of claim 19 further comprising an antenna coupled to the transceiver comprising either a patch or a coil antenna, the antenna having characteristics based on a frequency range of the RFID tags.

23. The master controller of claim 22 further comprising the storage location to store the database.

24. The master controller of claim 23 wherein the database further comprises one or more profiles associated with each item, each profile representing an activity, wherein the master controller further comprises a graphical user interface (GUI) to allow a selection of one of the profiles, to receive additional item descriptions, to assign a proximity threshold to either individual items or a profile, and to assign profiles and RFID tag identification codes to the items, and wherein the GUI further displays a description of items of the selected profile that are outside the associated proximity threshold.

25. The master controller of claim 24 wherein the master controller is programmable to automatically select one of the profiles based on at least one of a time-of-day, a day-of-week and geographic location of the master controller.

26. The master controller of claim 24 wherein the GUI receives the selection of one the profiles, the processor determines which items associated with the selected profile are not within a proximity threshold for the selected profile, provides an alert and instructs the GUI to display the items associated with the selected profile that are not within the associated proximity threshold.

27. The master controller of claim 26 wherein the processor, based on a signal strength of return signals, further determines when one of the items that was not within the proximity threshold for the selected profile comes into the proximity threshold for the selected profile and provides an alert.

28. A master controller for managing a plurality of managed items tagged with radio-frequency identification (RFID) tags, the master controller comprising:

a transceiver to transmit interrogation signals to RFID tags and to receive response signals from the RFID tags within communication range; and a processor to determine the proximity of the managed items based on signal levels of the response signals, and to provide a notification when certain ones of the managed items are within a proximity threshold, the proximity threshold being less than the communication range, wherein the master controller includes a memory to maintain a list of items within communication range of the master controller by the transceiver regularly transmitting an interrogation signal, the memory to further maintain a list of the items that are within a proximity threshold associated with the item, wherein the processor displays a received signal strength indicator based on return signals of a selected one of the managed items, and wherein the proximity threshold for each item is less than the communication range.

29. A master controller for managing a plurality of managed items tagged with radio-frequency identification (RFID) tags, the master controller comprising:

a transceiver to transmit interrogation signals to RFID tags and to receive response signals from the RFID tags within communication range; and a processor to determine the proximity of the managed items based on signal levels of the response signals, and to provide a notification when certain ones of the managed items are within a proximity threshold, the proximity threshold for each of the managed items being less than the communication range, wherein the items are personal, movable items, wherein each RFID tag has a unique identification code associated therewith, wherein the RFID tags generate a response signal in response to an interrogation signal transmitted by the transceiver, the response signal to include the unique identification code associated with the RFID tag, and wherein the processor performs a collision avoidance algorithm to help distinguish between response signals received substantially simultaneously from more than one of the RFID tags being interrogated.

30. A master controller for managing a plurality of managed items tagged with radio-frequency identification (RFID) tags, the master controller comprising:

a transceiver to transmit interrogation signals to RFID tags and to receive response signals from the RFID tags within communication range; and a processor to determine the proximity of the managed items based on signal levels of the response signals, and to provide a notification when certain ones of the managed items are within a proximity threshold, the proximity threshold being less than the communication range, wherein the master controller is part of a wireless communication device including one of a cellular or wireless telephone, a personal digital assistant (PDA) or a handheld portable communication device.

31. A method comprising:

interrogating a plurality of RFID-tagged items within communication range;

providing a notification when one or more of the tagged items is in a predetermined relation to a proximity threshold associated with each tagged item, the proximity threshold for each tagged item being less than the communication range; and accessing a database which includes a unique identification codes of the radio frequency identification tags, a description of the associated items, and a proximity threshold associated with each tagged item.

32. The method of claim 31 wherein the notification is provided when one or more of the tagged items are outside the associated proximity threshold.

33. The method of claim 31 wherein the notification is provided when one or more of the tagged items are within or at the associated proximity threshold.

34. The method of claim 31 further comprising:

displaying a received signal strength indicator for one of the tagged items on a user interface in response to the step of interrogating; and providing the notification when one or more of the tagged items that were outside the proximity threshold is within the proximity threshold.

35. A method comprising:

interrogating a plurality of RFID-tagged items within communication range;

providing a notification when one or more of the tagged items is in a predetermined relation to a proximity threshold; and performing a collision avoidance algorithm to distinguish between response signals received substantially simultaneously from more than one of the tagged items, wherein providing comprises accessing a database which includes unique identification codes of the radio frequency identification tags, a description of the associated items, and a proximity threshold associated with each tagged item.

36. The method of claim 35 further comprising:

determining the proximity of the tagged items based on signal levels of response signals and providing the notification when certain ones of the tagged items are outside the proximity threshold based on the signal levels, and wherein interrogating comprises transmitting an interrogation signal to tags associated with the tagged items and receiving the response signals, the response signals including a unique identification code of a radio frequency identification tag associated with each of the tagged items.

37. A method comprising:

interrogating a plurality of tagged items within communication range; and providing a notification when one or more of the tagged items is in a predetermined relation to a proximity threshold associated with each tagged item, the proximity threshold for each tagged item being less than the communication range;

determining when one or more of the tagged items associated with an activity profile is outside a proximity threshold associated with the profile; and providing the notification when one or more of the tagged items of the profile is outside the proximity threshold associated with the profile.

38. A method comprising:

interrogating a plurality of tagged items within communication range; and providing a notification when one or more of the tagged items is in a predetermined relation to a proximity threshold associated with each tagged item, the proximity threshold for each tagged item being less than the communication range, wherein prior to the interrogating and notifying, the method further comprises:

affixing radio frequency identification tags to the items;

generating a database to include unique identification codes of the radio frequency identification tags, a description of the associated items, and a proximity threshold associated with each item, wherein the database is generated using a graphical user interface (GUI) and stored in a master controller.

39. The method of claim 38 further comprising:

generating the database to further include one or more activity profiles associated with each item, each profile representing an activity;

receiving a selection of one of the profiles through the GUI; and displaying, by the GUI, a description of items of the selected profile that are determined to be outside the proximity threshold.

40. The method of claim 39 further comprising automatically selecting one of the activity profiles based on at least one of a time-of-day, a day-of-week and geographic location.

41. A computer-readable storage medium that stores instructions, which when executed by one or more processors, cause the processors to perform operations comprising:

instructing a transceiver to interrogate a plurality of RFID-tagged items and receive response signals from RFID-tagged items within communication range;

providing a notification when one or more of the tagged items is outside a proximity threshold associated with the tagged items, the proximity threshold being less than the communication range; and accessing a database which includes unique identification codes of the radio frequency identification tags, a description of the associated items, and a proximity threshold associated with each tagged item.

42. A computer-readable storage medium that stores instructions, which when executed by one or more processors, cause the processors to perform operations comprising:

instructing a transceiver to interrogate a plurality of tagged items;

providing a notification when one or more of the tagged items is outside a proximity threshold; and performing a collision avoidance algorithm to distinguish between response signals received substantially simultaneously from more than one of the tagged items.

43. The computer-readable storage medium of claim 42 wherein the instructions, when further executed by one or more of the processors cause the processors to perform operations further comprising:

storing a database to include a unique identification code of radio frequency identification tags, a description of an associated item, and a proximity threshold associated with each item, wherein the database is generated using a graphical user interface (GUI) and stored in a master controller.

44. The computer-readable storage medium of claim 43 wherein the instructions, when further executed by one or more of the processors cause the processors to perform operations, wherein storing the database further includes one or more activity profiles associated with each item, each profile representing an activity, the operations to further include:

receiving a selection of one of the profiles through the GUI; and displaying, by the GUI, a description of items of the selected profile that are determined to be outside the proximity threshold.

45. A method of locating an item comprising:

transmitting an interrogation signal;

receiving a response signal in response to the interrogation signal from a radio-frequency identification (RFID) tag to determine when an item tagged with the RFID tag is within communication range;

providing a notification when the item is within a proximity threshold, the proximity threshold being less than the communication range; and accessing a database which includes a unique identification code of the radio frequency identification tag, a description of the associated item, and a proximity threshold associated with the tagged item.

46. A method of locating an item comprising:

transmitting an interrogation signal;

receiving a response signal in response to the interrogation signal from a radio-frequency identification (RFID) tag to determine when an item tagged with the RFID tag is within communication range; and providing a notification when the item is within a proximity threshold, the proximity threshold being less than the communication range, wherein a plurality of items are affixed with the RFID tags, each tag having a unique code associated therewith, wherein a master controller transmits the interrogation signal and receives response signals from at least some of the RFID tags, and wherein the method further comprises performing a collision avoidance algorithm to distinguish between response signals received substantially simultaneously from by more than one of the RFID tags.

47. The method of claim 46 wherein the proximity threshold is selectable.

48. The method of claim 46 wherein the plurality of items include personal items of either an elderly or an infirm person including at least some of eyeglasses, artificial teeth replacements, prescription drugs, and a hearing aid.

* * * * *

UNITED STATES PATENT AND TRADEMARK OFFICE

CERTIFICATE OF CORRECTION

PATENT NO. : 7,274,292 B2
APPLICATION NO. : 10/877562
DATED : September 25, 2007
INVENTOR(S) : Velhal et al.

It is certified that error appears in the above-identified patent and that said Letters Patent is hereby corrected as shown below:

In column 13, line 7, in Claim 11, after “home” insert -- , --.

In column 16, line 22, in Claim 31, before “unique” delete “a”.

Signed and Sealed this

Twenty-fifth Day of December, 2007

JON W. DUDAS
*Director of the United States Patent and Trademark Office*